US005697605A

United States Patent [19]

Pollich et al.

[11] Patent Number: 5,697,605

[45] Date of Patent: Dec. 16, 1997

[54] SHEET DELIVERY FOR A PRINTING PRESS

[75] Inventors: Gerhard Pollich, Heidelberg; Josef Wehle, Schwetzingen, both of Germany

[73] Assignee: Heidelberger Druckmaschinen AG, Heidelberg, Germany

[21] Appl. No.: 610,524

[22] Filed: Mar. 4, 1996

[30] Foreign Application Priority Data

Mar. 3, 1995 [DE] Germany ..... 195 07 370.3

[51] Int. Cl.[6] ..... B65H 29/34

[52] U.S. Cl. ..... 271/189; 271/218; 271/220

[58] Field of Search ..... 271/213, 218, 271/219, 220, 189; 414/790.8

[56] References Cited

U.S. PATENT DOCUMENTS

| | | | |
|---|---|---|---|
| 2,631,038 | 3/1953 | Wood et al. | 271/218 |
| 2,836,418 | 5/1958 | Blattner et al. | 271/189 |
| 3,966,195 | 6/1976 | Simeth . | |
| 5,125,639 | 6/1992 | Henn | 271/213 |
| 5,131,647 | 7/1992 | Henn | 271/189 |
| 5,377,588 | 1/1995 | Fricke et al. . | |

FOREIGN PATENT DOCUMENTS

| | | |
|---|---|---|
| 23 01 840 | 3/1981 | Germany . |
| 40 01 565 | 7/1991 | Germany . |
| 40 11 286 | 4/1992 | Germany . |
| 41 31 015 | 4/1993 | Germany . |
| 42 41 787 | 6/1994 | Germany . |
| 43 17 357 | 11/1994 | Germany . |

*Primary Examiner*—H. Grant Skaggs

*Attorney, Agent, or Firm*—Herbert L. Lerner; Laurence A. Greenberg

[57] ABSTRACT

Sheet delivery for a printing press includes a removable sheet stop, and sheet catchers movable into the sheet delivery for catching sheets to be deposited on a sheet pile while the sheets are yet above the sheet pile, for purposes of both removing a sample sheet and inserting an auxiliary pile holder, the sheet catchers being disposed at an outer end of the sheet pile and being introducible with a close spacing from delivery grippers transporting the sheets to be deposited, the sheet stop being removable from the sheet pile for enabling a sample sheet to be taken, and the sheet catchers being bringable into a position therein at least by respective front ends thereof they have a slight spacing from the sheet pile enabling the auxiliary pile holder to be inserted, the surface of the sheet pile being lowerable so that the auxiliary pile holder is insertable between a lower end of the sheet stop and a top surface of the sheet pile.

11 Claims, 4 Drawing Sheets

SHEET DELIVERY FOR A PRINTING PRESS

BACKGROUND OF THE INVENTION

Field of the Invention

The invention relates to a sheet delivery for a printing press, with a removable sheet stop and with sheet catchers which are movable into the sheet delivery for catching sheets to be deposited while the sheets are yet above the sheet pile, both for the purpose of removing a sample or inspection sheet and inserting an auxiliary pile holder.

For printing presses to operate economically, they must run nonstop. A device must therefore be provided by means of which, while the printing press is running, the pile of the sheet delivery can be removed and a pallet for a new pile disposed in its place (nonstop operation). For this purpose, devices exist for intercepting sheets, which are successively introduced above the pile which is to be removed. Auxiliary pile holders often serve as an intercepting device; they are either withdrawn again after a new pallet is inserted, or serve as a pallet for the new pile. Because modern printing presses run at very high speed, however, the problem arises that, during the time the auxiliary pile holder is being inserted, several sheets arrive which, without further precautions being taken, would cause a disruption.

Furthermore, the need arises that, during the operation of the printing press, a sample or inspection sheet be able to be taken from the pile of the sheet delivery, so that the pressman can check the quality of the printing. For this purpose, as well, it is necessary that the successive sheets to be intercepted so as to take a sample or inspection sheet.

Published German Patent Document DE 40 11 286 C2 proposes, for a sheet delivery of the type referred to at the introduction hereto, that suction fingers be introduced over the pile of the delivery for grasping both the leading and trailing ends of the successive sheets and holding then above the pile and, simultaneously, pulling them taut. A sheet stop is removed both for the insertion of the auxiliary pile holder and for removing the sample or inspection sheet.

A disadvantage of the foregoing heretofore known device is that the suction fingers must hold the successive sheets on all sides thereof in order to keep them suspended or freely floating above the pile. This is a relatively complicated and expensive device, and the danger arises that the suction fingers may not be able to keep a relatively large number of successive sheets in suspension or freely floating very long, so that they may slip away from the suction fingers.

SUMMARY OF THE INVENTION

It is accordingly an object of the invention to provide a sheet delivery for a printing press of the type referred to in the introduction hereto which is of relatively simple construction and can be used in a functionally reliable manner both for pile changing, as well as for removing sample or inspection sheets.

With the forgoing and other objects in view, there is provided, in accordance with the invention, a sheet delivery for a printing press, comprising a removable sheet stop, and sheet catchers movable into the sheet delivery for catching sheets to be deposited on a sheet pile while the sheets are yet above the sheet pile, for purposes of both removing a sample sheet and inserting an auxiliary pile holder, the sheet catchers being disposed at an outer end of the sheet pile and being introducible with a close spacing from delivery grippers transporting the sheets to be deposited, the sheet stop being removable from the sheet pile for enabling a sample sheet to be taken, and the sheet catchers being bringable into a position wherein at least by respective front ends thereof they have a slight spacing from the sheet pile enabling the auxiliary pile holder to be inserted, the surface of the sheet pile being lowerable so that the auxiliary pile holder is insertable between a lower end of the sheet stop and a top surface of the sheet pile.

In accordance with another feature of the invention, the sheet catchers are horizontally oriented and are introducible horizontally, the sheet catchers being vertically adjustable to a respective level for a position at which the sample sheet is taken and for a position at which the auxiliary pile holder is inserted.

In accordance with a further feature of the invention, the sheet catchers are oriented horizontally and are introducible horizontally, for taking the sample sheet, and the sheet catchers are swivelable, at the latest after termination of the introduction thereof, so that the front ends thereof are slightly spaced from the sheet pile, for inserting the auxiliary pile holder.

In accordance with an added feature of the invention, the sheet catchers have a disposition and length of such dimension that an angle through which they are swivelable and a region of the intercepted sheets supported thereby are at an angle to the horizontal which is acute as possible.

In accordance with an additional feature of the invention, the sheet catchers are formed with suction nozzles at an upper side of a front region thereof.

In accordance with yet another feature of the invention, the sheet delivery includes a vertical guide and a horizontal guide supporting the sheet catchers, and a horizontal drive and a vertical drive for driving the sheet catchers.

In accordance with yet a further feature of the invention, the sheet delivery includes guide elements displaceable in horizontal guides, and a shaft swivelably supported in the guide elements, the sheet catchers being connected to one another via the shaft.

In accordance with yet an added feature of the invention, the shaft is operatively connected with a swivel drive.

In accordance with yet an additional feature of the invention, the sheet delivery includes a horizontal drive for displacing the guide elements in the horizontal guides, at least one control lever secured to the shaft and displaceable therewith horizontally into engagement with another stop, the shaft being swivelable, together with the sheet catchers, counter to the force of at least one spring.

In accordance with still another feature of the invention, the other stop is secured to the sheet stop, and the other stop is removable together with the sheet stop out of the way of control lever.

In accordance with still a further feature of the invention, the other stop is adjustably fastened to the sheet stop.

In accordance with still an added feature of the invention, at least one toggle lever arrangement operatively connected to a drive shaft for displacing the guide elements in the horizontal guides.

In accordance with still an additional feature of the invention, the sheet delivery includes a tube connected to the sheet catchers for applying suction air to the suction nozzles.

In accordance with a concomitant feature of the invention, at least the horizontal drive is a pneumatic drive.

The aforementioned object of the invention is thus attained by the fact that, in order to accomplish the taking or removing of a sample sheet, sheet catchers disposed at the outer end of the pile can be introduced with a close spacing from the delivery grippers which bring on the sheets to be deposited, the sample sheet being able to be taken or removed by providing that the sheet stop be removable from the pile; for the insertion of an auxiliary pile holder, the sheet catchers can be brought into a position wherein, at least with the front ends thereof, they have a slight spacing from the pile, which is nevertheless sufficient to permit the insertion of the auxiliary pile holder, while the surface of the pile is lowered so that the auxiliary pile holder can be introduced between the lower end of the sheet stop and the top surface of the pile.

The inventive device is of relatively simple construction, because the sheet catchers need be disposed only at one side of the pile.

Different positions of the sheet catchers for taking or removing the sample sheets and for the insertion of an auxiliary pile holder call for taking various conditions properly into consideration. In particular, by means of these different positions, the ends of the successive sheets in both cases are held closely above the surface of the pile, and it is therefore not disadvantageous if the lower end of the intercepted sheets rests on the pile or on the auxiliary pile holder. Furthermore achieved thereby is that the sheets, resting by the front ends thereof on the sheet catchers, form a very flat or small angle with the pile, and the auxiliary pile holder can therefore very easily be thrust between the deposited sheets of the pile and the sheets intercepted by the auxiliary pile holder, without the sheets slipping downward from the auxiliary pile holder or without any relative motion between the held sheets, which could cause smearing. The lower positioning of the sheet catchers for the insertion of the auxiliary pile holder also takes into consideration that the time required is longer than for taking a sample sheet and, in a case wherein the auxiliary pile holder is to be removed again, a larger number of successive sheets must be deposited on the sheet catchers and the auxiliary pile holder, because a new pallet is provided for the new pile.

An embodiment of the invention provides that the sheet catchers be horizontally oriented and be introducible horizontally and that, prior to the introduction, by means of a vertical adjustment, they are brought to the level for the position for taking the specimen sheet or to the level for the position for inserting the auxiliary pile holder.

Another embodiment provides that the sheet catchers, for taking the sample sheet, be oriented horizontally and be introducible horizontally, and that the sheet catchers, for the insertion of the auxiliary pile holder, be swiveled, at the latest after the termination of the introduction thereof, so that the front ends thereof have the slight spacing from the pile. The advantage of this embodiment is that, in this manner, an even flatter or smaller angle can be attained between the sheets resting on the sheet catchers and the surface of the pile. In this manner, the aforementioned advantages become even more clearly evident. Advantageously, the disposition and length of the sheet catchers are such that the swivel angle and thus the support for the engaged region of the intercepted sheets are at an angle to the horizontal which is as acute as possible.

To prevent the sheets from slipping down from the sheet catchers, the sheet catchers may be provided with a suitable surface, such as a rubber coating. Preferably, the sheet catchers are equipped in the front region of the top thereof with suction nozzles, by which the intercepted sheets are held. The sheets are thereby optimally held, even though, in contrast with the state of the prior art discussed at the introduction hereto, the suction is not absolutely necessary for the functioning or operation of the device.

The positioning of the sheet catchers can be effected in different ways, depending upon the particular embodiment thereof. For example, it is possible for the sheet catchers to be supported by means of a vertical guide and a horizontal guide and to be equipped with a horizontal drive and a vertical drive.

In the embodiment with the swivelable sheet catchers, an exemplary construction provides for the sheet catchers to be connected to one another via a shaft which is swivelably supported in guide elements which are displaceable in horizontal guides. This exemplary embodiment may have a construction wherein the shaft is operatively connected to a swivel drive. It is also possible, however, that the guide elements are displaceable by means of a horizontal drive, and that at least one control lever is secured to the shaft and, as a result of the horizontal motion, strikes another stop and thereby swivels the shaft, together with the sheet catchers, counter to the force of at least one spring. It is especially expedient if the other stop is secured to the sheet stop, and thus can be removed together with the sheet stop out of the way of the control lever. The advantage of this embodiment is that, firstly, only a horizontal drive is needed, and secondly, the swiveling motions occur only with the other stop closed. In this manner, by swiveling the sheet stop out of the way so that a sample sheet can be taken, the sheet catchers are moved inwardly in a horizontal orientation, as is required for taking or removing the sample sheet, and when the sheet stop is not swiveled out of the way, the swiveling of the sheet catchers is set into motion in the manner necessary to reach the position for the insertion of the auxiliary pile holder. For optimal adjustment of this function, it is expedient to secure the other stop adjustably to the sheet stop. In this manner, both the instant of response and the swivel angle can be adjusted.

The horizontal drive for displacing the guide elements can be embodied in various ways. It is possible to use pneumatic cylinders or lifting magnets, but an operating lever for manual operation may also be provided. An exemplary embodiment provides for the displacement of the guide elements in the horizontal guides to be effected by means of at least one toggle lever arrangement operatively connected to a drive shaft. The drive shaft can be driven in the most various ways.

If the sheet catchers are acted upon by suction air, it is expedient for the sheet catchers to be acted upon jointly by suction air via a tube, which may be the shaft by which the sheet catchers are connected to one another.

It is believed to be readily apparent that other guides and drives for the sheet catchers are also conceivable.

Other features which are considered as characteristic for the invention are set forth in the appended claims.

Although the invention is illustrated and described herein as embodied in a sheet delivery for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
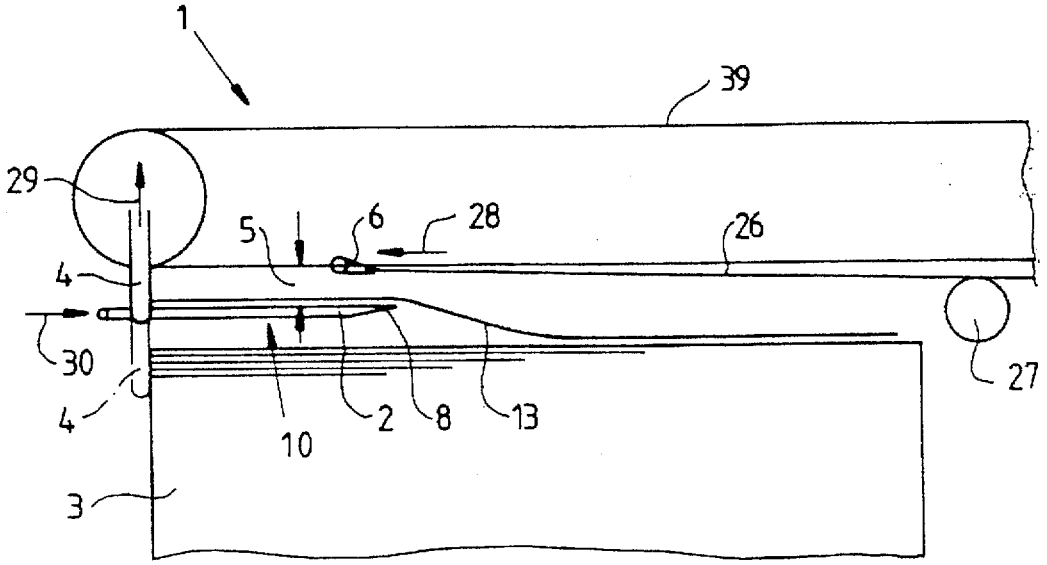
FIG. 1 is a basic diagrammatic side elevational view of an embodiment of a sheet delivery for a printing press according to the invention which is in position for removing a sample or inspection sheet therefrom.

Referring now to the drawings and, first, particularly to FIG. 1 thereof, there is shown therein, in a basic sketch, an embodiment of a sheet delivery 1 in a position for taking a sample or inspection sheet therefrom.

By means of revolving transport or conveyor chains 39 whereon delivery grippers 6 are mounted, the sheet delivery 1 transports sheets 26, which are to be deposited, to a pile 3. A sheet stop 4 provides for a clean placement on the pile 3 of the sheets 26 which are to be deposited. To deposit the sheets 26, the delivery grippers 6 open and a sheet brake 27 brakes a sheet 26 to be deposited so that the sheet 26 continues to slide as far as the sheet stop 4. If a sample or inspection sheet is to be taken, it is then necessary for the sheet stop 4 to be removed. The removal of the sheet stop 4 can be performed in the direction of an arrow 29, or the sheet stop 4 can also be removed by a swiveling movement. Because modern printing presses operate at very high speed, however, it is no longer possible to grasp a sheet and put it back into its stop position before the arrival of the next sheet. For this reason, sheet catchers 2 are provided. For taking a sample or inspection sheet, the sheet catchers 2 are thrust inwardly, and the sheet stop 4 is removed. After the sample sheet has been taken, the sheet stop 4 is put back into its stop position, and the sheet catchers 2 are removed from the interception position thereof again, so that the intercepted sheets 13 can be deposited on the pile 3 once more. The sheet catchers 2 must be introduced with the least possible spacing 5 from the delivery grippers 6 approaching with the sheets 26 which are to be deposited, so that there will be enough room for grasping a sample or inspection sheet.

Figure 2:
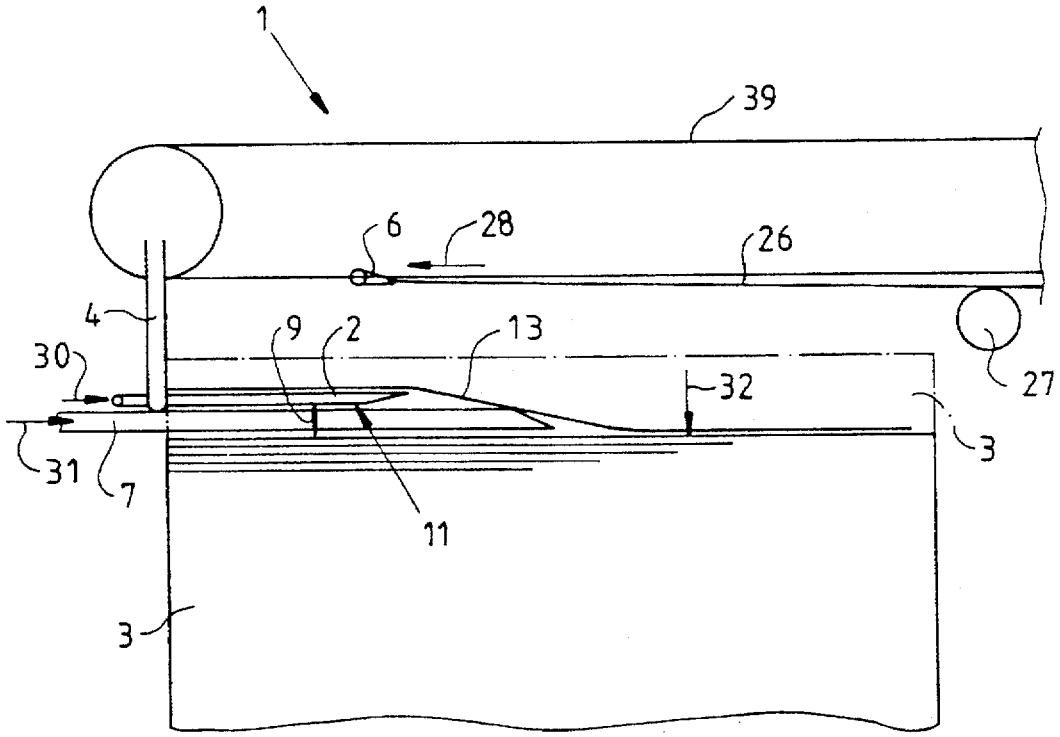
FIG. 2 is a view like that of FIG. 1 of the sheet delivery in a position for inserting an auxiliary pile holder therein.

FIG. 2 shows the same embodiment of the invention, but in a different operating phase thereof, i.e., in a position for the insertion of an auxiliary pile holder 7. For this purpose, the pile 3 is lowered (as represented by an arrow 32) from the position represented by the phantom or dot-dash lines to the position shown in solid lines. The lowering of the pile 3 must be to such an extent that an auxiliary pile holder 7 can be introduced between the lower end of the sheet stop 4 and the upper surface of the pile 3. In the course of introducing the auxiliary pile holder 7, as well, the problem arises that in modern high-speed presses, several sheets will arrive during the insertion of the auxiliary pile holder 7 and would be destroyed if no precautions were taken. Besides the problem of sheet destruction, the crumpled sheets would hinder the operation of the sheet delivery. To that end, sheet catchers 2 are brought into a position 11 wherein they intercept the following sheets 13. Compared with the position shown in FIG. 1, the sheet catchers 2 must be displaced vertically downwardly for that purpose and then thrust horizontally inwardly. The successive sheets 13 are intercepted by the sheet catchers 2, and a slight spacing 9 between the sheet catchers 2 and the top of the pile 3 serves to dispose the intercepted sheets 13 at an angle to the surface of the pile 3 which is as acute as possible. Consequently, the auxiliary pile holder 7 can easily be thrust inwardly without the intercepted sheets 13 being pulled downwardly by the sheet catchers 2. After the insertion of the auxiliary pile holder 7, the latter may remain in place and act as a pallet for the new pile. In that case, after the introduction of the auxiliary pile holder 7, the sheet catchers 2 are pulled out again opposite to the direction of the arrow 30 in which they were introduced. It is also possible, however, after the insertion of the auxiliary pile holder 7, to place a new pallet thereunder, and then to pull the auxiliary pile holder 7 and the sheet catchers 2 out again, so that the intercepted sheets 13 settle on the new pallet.

As noted hereinbefore, the arrow 32 represents the lowering of the pile 3; in normal operation, the upper surface of the pile 3 must be at a height at least as great as the height at which the sheets 26 engage the sheet stop 4.

Figure 3:
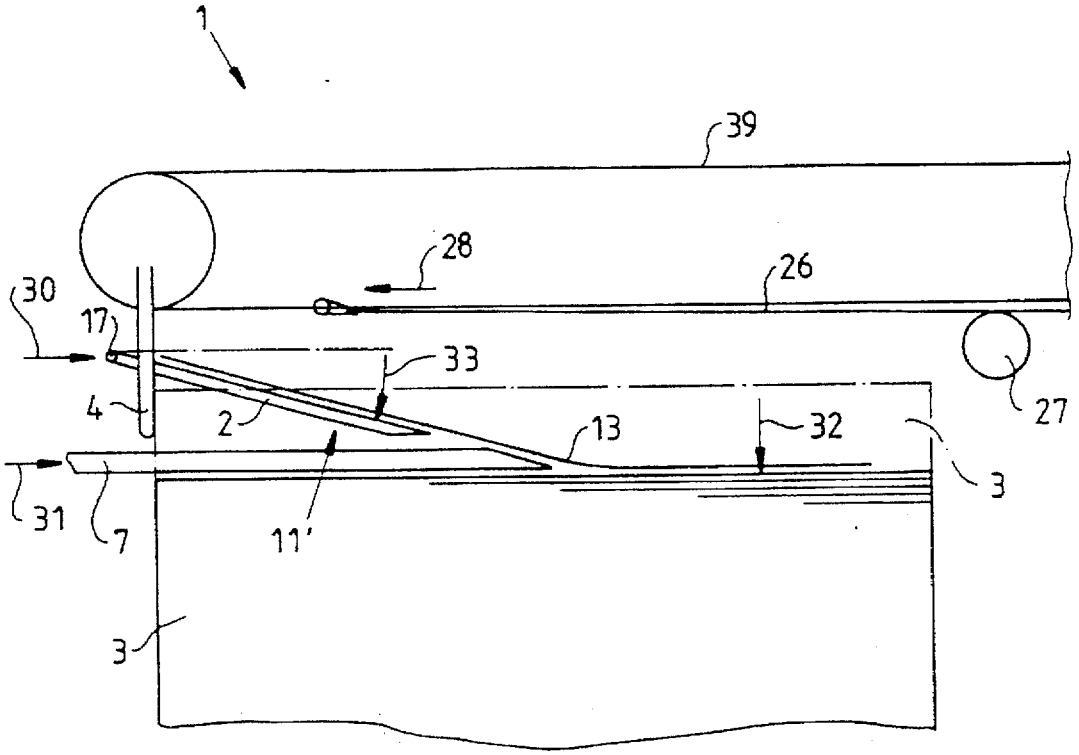
FIG. 3 is a view like that of FIG. 2, a different embodiment of the sheet delivery in the position for inserting the auxiliary pile holder.

FIG. 3 provides a basic sketch of another embodiment of the sheet delivery according to the invention in the position for inserting the auxiliary pile holder 7. This embodiment is identical to that of FIGS. 1 and 2, with respect to the taking of the sample or inspection sheet. The insertion of the auxiliary pile holder 7 differs, however, in that the sheet catchers 2 intercept the sheets 13 in a swiveled position 11. For a pile change, in this embodiment as well, the pile 3 is lowered, as the arrow 32 indicates and, for the interception of the sheets 13, the sheet catchers 2 are introduced in the direction of the arrow 30, however, in this embodiment, the sheet catchers 2 are also swiveled in the direction represented by the arrow 33. The lower end of the sheet catchers 2 are then positioned so that the auxiliary pile holder 7 can be introduced between the sheet catchers 2 and the pile 3. It is believed to be readily apparent from FIG. 3 of the drawings how an intercepted sheet 13 comes to rest in such a way that it forms an acute angle with the top surface of the sheet pile 3, the acute angle thus formed facilitating the introduction of the auxiliary pile holder 7. The remaining operations are equivalent to those which have already been described with regard to FIG. 2.

Figure 4:
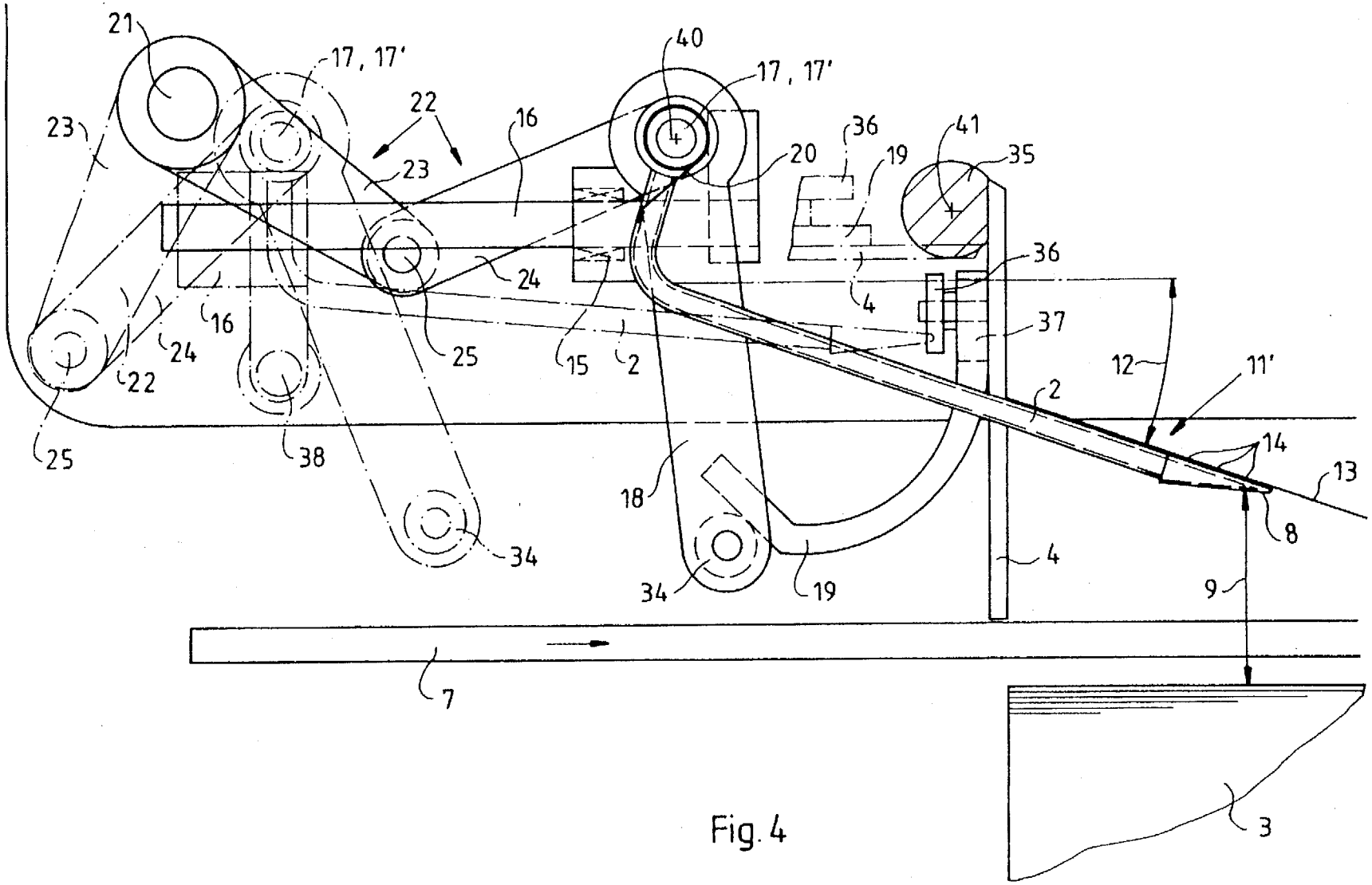
FIG. 4 is an enlarged side elevational view of an exemplary embodiment of the sheet delivery corresponding generally to the diagrammatic view of FIG. 3.
Figure 5:
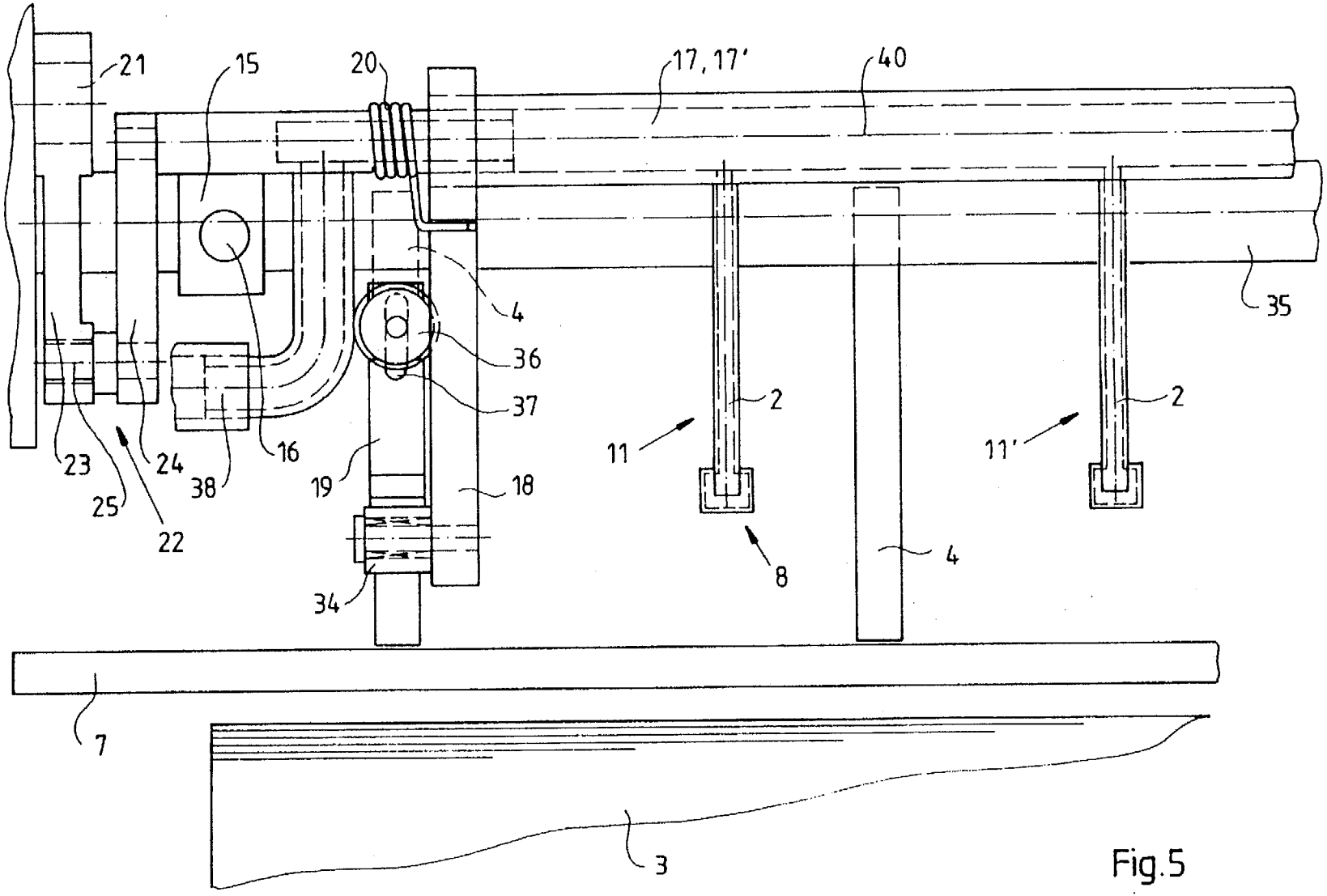
FIG. 5 is a front elevational view of FIG. 4 as seen from the right-hand side thereof.

FIGS. 4 and 5 illustrate an exemplary embodiment of the device according to the invention, FIG. 4 being a side elevational view, and FIG. 5 being a front elevational view.

The embodiment of FIGS. 4 and 5 includes both the sheet catchers 2 with their guidance and their drive, and the sheet stop 4. The sheet catchers 2 are secured on a swivel shaft 40 which simultaneously serves as a tube 17 for supplying suction air. The sheet catchers 2 are hollow and, on an upper side of a front end 8 thereof, are formed with suction nozzles 14 serving to provide a better hold on the intercepted sheets 13. The swivel shaft 40 formed, as aforementioned, as a hollow shaft or tube 17, 17', is supported in guide elements 15, which are displaceable in horizontal guides 16. Horizontal displacement is achieved by means of a toggle lever arrangement 22. A first toggle lever 23 of this toggle lever arrangement 22 is connected to a drive shaft 21. The first toggle lever 23, in turn, is connected via a toggle lever joint 25 to a second toggle lever 24 which, in turn, is connected to the swivel shaft 40 to permit mutual rotation. By a rotation of the drive shaft 21, the toggle lever arrangement 22 can be placed in the position thereof represented by solid lines, wherein it is extended or stretched out and thereby displaces the guide elements 15 with the sheet catchers 2 in a direction towards the pile 3. An opposite rotation of the drive shaft 21 causes the toggle lever arrangement 22 to be drawn into the position shown in phantom by dot-dash lines, by which the guide elements 15 are removed with the sheet catchers 2 from the pile 3.

In order to perform the swiveling movement, the shaft 17 is firmly connected to a control lever 18, which has a control lever roller 34 cooperating with a stop 19. If the guide elements 15 are displaced by means of the toggle lever arrangement 22 in the direction towards the pile 3 along the horizontal guide 16, the control lever roller 34 then engages the stop 19, and the shaft 17 is accordingly rotated counter to the force of a spring 20, and the sheet catchers 2 are moved into the position shown wherein they are swiveled through the swivel angle 12 with respect to the horizontal. The spring 20 is braced against and between the control lever 18 and the guide element 15. If the guide elements 15 are retracted via the drive shaft 21 and the toggle lever arrangement 22, the spring 20 then the shaft 17 to swivel, and the sheet catchers 2 are likewise swiveled back into a horizontal or nearly horizontal position (the phantom or dot-dash position thereof). The stop 19 is disposed on the sheet stop 4, which can be swiveled by means of a sheet stop shaft 35 about an axis 41 into a perpendicular stop position thereof or into a position shown in phantom or dot-dash lines wherein the sheet stop 4 has been swiveled out of the way. In this swiveled-away position of the sheet stop 4, which is the position in which a sample or inspection sheet is taken, the stop 19 is also swiveled away, permitting, therefore, a horizontal introduction of the sheet catcher 2 into the position 10 for taking the sample or inspection sheet. Thus, in an especially simple manner, the swiveling of the sheet stop 4 out of the way is linked with the control mechanism for the sheet catchers 2, so that a correct positioning thereof will always be achieved.

Further shown is how the stop 19 is adjustable. To that end, the stop 19 is secured to the sheet stop 4 by means of both a set screw 36 and a slot 37. The stop 19 is thereby adjustable in height or elevation, so that its response position can be adjusted. The auxiliary pile holder 7 is also shown introduced between the lower end of the sheet stop 4 and the upper side of the pile 3. The tube 17 communicates with a suction-air connection or union 38.

The mechanism shown can be disposed on one side or both sides of the printing press, depending upon the width of the press and the forces acting upon the sheet catchers 2.

We claim:

1. Sheet delivery for a printing press, comprising a removable sheet stop, and sheet catchers movable into the sheet delivery for catching sheets to be deposited on a sheet pile while the sheets are yet above the sheet pile, for purposes of both removing a sample sheet and inserting an auxiliary end of the sheet pile and being introducible with a close spacing from delivery grippers transporting the sheets to be deposited, said sheet stop being removable from the sheet pile for enabling a sample sheet to be taken, and said sheet catchers being bringable into a position wherein at least by respective front ends thereof they have a slight spacing from the sheet pile enabling said auxiliary pile holder to be inserted, the surface of the sheet pile being lowerable so that said auxiliary pile holder is insertable between a lower end of said sheet stop and a top surface of the sheet pile, said sheet catchers being horizontally oriented and being introducible horizontally, said sheet catchers being vertically adjustable to a respective level for a position at which the sample sheet is taken and for a position at which the auxiliary pile holder is inserted.

2. Sheet delivery according to claim 1, wherein said sheet catchers are formed with suction nozzles at an upper side of a front region thereof.

3. Sheet delivery according to claim 2, including a tube connected to said sheet catchers for applying suction air to said suction nozzles.

4. Sheet delivery for a printing press, comprising a removable sheet stop, and sheet catchers movable into the sheet delivery for catching sheets to be deposited on a sheet pile while the sheets are yet above the sheet pile, for purposes of both removing a sample sheet and inserting an auxiliary end of the sheet pile and being introducible with a close spacing from delivery grippers transporting the sheets to be deposited, said sheet stop being removable from the sheet pile for enabling a sample sheet to be taken, and said sheet catchers being bringable into a position wherein at least by respective front ends thereof they have a slight spacing from the sheet pile enabling said auxiliary pile holder to be inserted, the surface of the sheet pile being lowerable so that said auxiliary pile holder is insertable between a lower end of said sheet stop and a top surface of the sheet pile, wherein said sheet catchers are oriented horizontally and are introducible horizontally, for taking the sample sheet, and said sheet catchers are swivelable, at the latest after termination of the introduction thereof, so that said front ends thereof are slightly spaced from the sheet pile, for inserting said auxiliary pile holder.

5. Sheet delivery according to claims 4, wherein said sheet catchers have a disposition and length of such dimension that an angle through which they are swivelable and a region of the intercepted sheets supported thereby are at a substantially acute angle to the horizontal.

6. Sheet delivery for a printing press, comprising a removable sheet stop, and sheet catchers movable into the sheet delivery for catching sheets to be deposited on a sheet pile while the sheets are yet above the sheet pile, for purposes of both removing a sample sheet and inserting an auxiliary end of the sheet pile and being introducible with a close spacing from delivery grippers transporting the sheets to be deposited, said sheet stop being removable from the sheet pile for enabling a sample sheet to be taken, and said sheet catchers being bringable into a position wherein at least by respective front ends thereof they have a slight spacing from the sheet pile enabling said auxiliary pile holder to be inserted, the surface of the sheet pile being lowerable so that said auxiliary pile holder is insertable between a lower end of said sheet stop and a top surface of the sheet pile and guide elements displaceable in horizontal guides, and a shaft swivelably supported in said guide elements, said sheet catchers being connected to one another via said shaft.

7. Sheet delivery according to claim 6, wherein said shaft is operatively connected with a swivel drive.

8. Sheet delivery according to claim 6, including a horizontal drive for displacing said guide elements in said horizontal guides, at least one control lever secured to said shaft and displaceable therewith horizontally into engagement with an other stop, said shaft being swivelable, together with said sheet catchers, counter to the force of at least one spring.

9. Sheet delivery according to claim 8, wherein said other stop is secured to said sheet stop, and said other stop is removable together with said sheet stop out of the way of control lever.

10. Sheet delivery according to claim 9, wherein said other stop is adjustably fastened to said sheet stop.

11. Sheet delivery according to claims 6, at least one toggle lever arrangement operatively connected to a drive shaft for displacing said guide elements in said horizontal guides.

* * * * *